US006021603A

United States Patent [19]

Prete et al.

[11] Patent Number: 6,021,603

[45] Date of Patent: Feb. 8, 2000

[54] TILT-LATCH WITH BOLT STOP

[75] Inventors: James G. Prete, Hinsdale, Ill.; Michael P. Bratcher, Munster; James Sharp, Cedar Lake, both of Ind.; Jason Annes, Chicago, Ill.; Steven E. Schultz, Demotte, Ind.

[73] Assignee: Ashland Products, Inc., Lowell, Ind.

[21] Appl. No.: 09/056,210

[22] Filed: Apr. 7, 1998

[51] Int. Cl.[7] ..... E05D 15/22

[52] U.S. Cl. ..... 49/183; 292/42

[58] Field of Search ..... 49/181, 183–185; 292/174, 175, DIG. 37, DIG. 63

[56] References Cited

U.S. PATENT DOCUMENTS

| | | | |
|---|---|---|---|
| 16,228 | 12/1856 | Copeland . | |
| 1,781,729 | 11/1930 | Major . | |
| 4,475,311 | 10/1984 | Gibson . | |
| 4,553,353 | 11/1985 | Simpson . | |
| 4,578,903 | 4/1986 | Simpson . | |
| 4,581,850 | 4/1986 | Simpson . | |
| 4,622,778 | 11/1986 | Simpson . | |
| 4,669,765 | 6/1987 | Ullman . | |
| 4,790,579 | 12/1988 | Maxwell et al. . | |
| 4,791,756 | 12/1988 | Simpson . | |
| 4,824,154 | 4/1989 | Simpson . | |
| 4,837,975 | 6/1989 | Simpson . | |
| 4,901,475 | 2/1990 | Simpson . | |
| 5,028,083 | 7/1991 | Mischenko . | |
| 5,096,240 | 3/1992 | Schultz . | |
| 5,121,951 | 6/1992 | Harbom et al. . | |
| 5,121,952 | 6/1992 | Jason | 292/175 |
| 5,139,291 | 8/1992 | Schultz | 292/42 |
| 5,669,639 | 9/1997 | Lawrence . | |
| 5,671,958 | 9/1997 | Szapucki et al. . | |

OTHER PUBLICATIONS

Ro–Mai Industries, Inc. Drawing No. EXP–021, Apr. 9, 1990.

Ro–Mai Industries, Inc. Drawing No. 110–2242, Apr. 14, 1992.

*Primary Examiner*—Daniel P. Stodola
*Assistant Examiner*—Hugh B. Thompson
*Attorney, Agent, or Firm*—Wallenstein & Wagner, Ltd.

[57] ABSTRACT

A tilt latch (10) for a sash window (12) has a bolt stop. The sash window (12) is disposed within opposed guide rails (16) on a master frame (14). The sash window (12) is comprised of a top sash rail (20), a base (22) and two stiles (24,26) connected together at their extremities. The tilt-latch (10) is adapted for releasably securing the sash window (12) to the master frame (14). The tilt-latch (10) is comprised of a housing (42) adapted to be supported by the top rail (20). The housing (42) has an outward end opening (44). A latch bolt (46) is disposed within the housing (42) and has a nose adapted for engaging a respective one of the guide rails (16). A protrusion (80) is located either on the latch bolt (46) or the housing (42) and a lock wall (86) is located either on the housing (42) or the latch bolt (46). The protrusion (80) has a stop surface (84) and is moveable between a first position defining a prevent position (94) wherein the stop surface (84) is adapted to abut the lock wall (86) to prevent retraction of the latch bolt (46) into the housing (42), and a second position defining a deflected position (96) wherein the stop surface (84) does not abut the lock wall (86) to allow retraction of the latch bolt (46) into the housing (42). The protrusion (80) is biased to the prevent position.

21 Claims, 8 Drawing Sheets

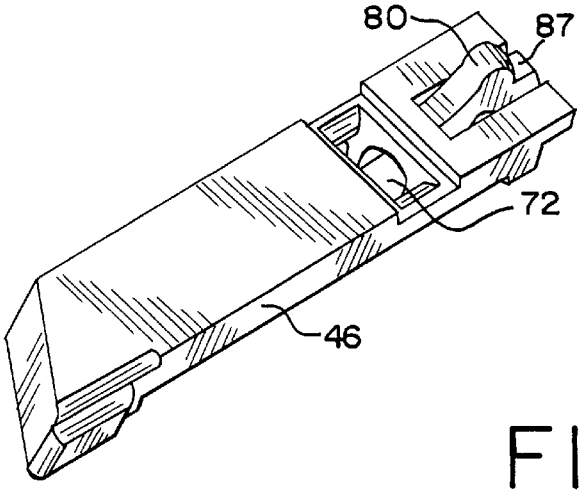
FIG. 4
FIG. 5
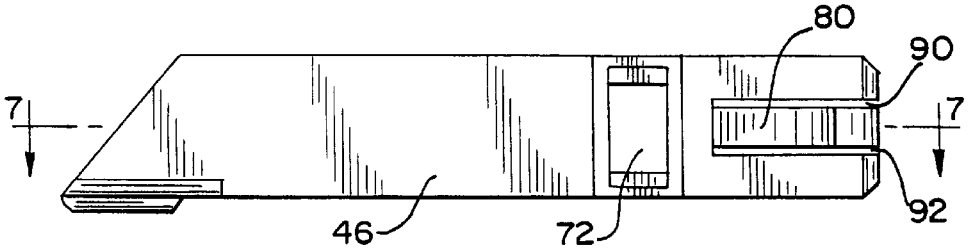
FIG. 6
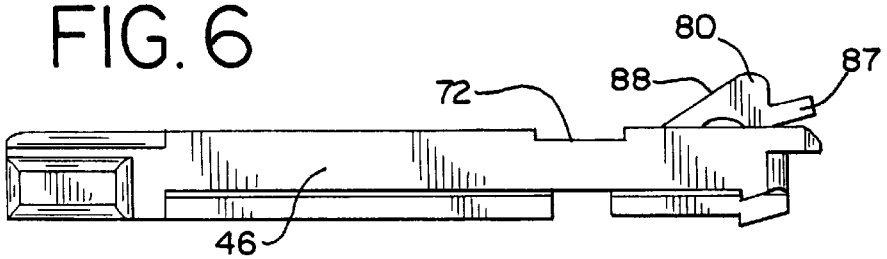
FIG. 7
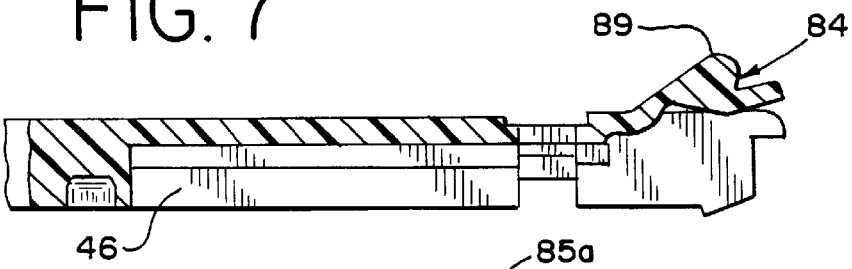
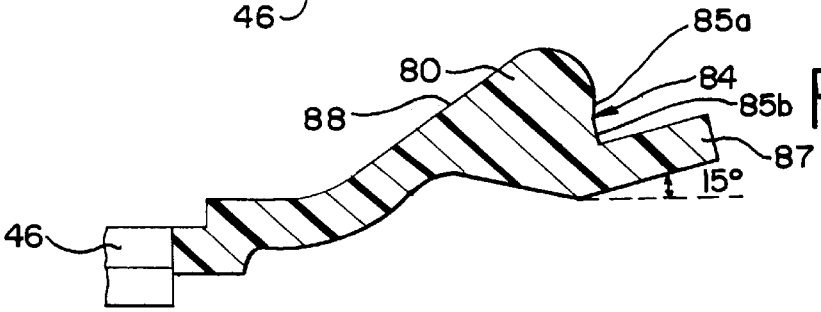
FIG. 8

TILT-LATCH WITH BOLT STOP

TECHNICAL FIELD

The present invention relates to a tilt-latch for a pivotal sash window assembly and, more particularly, to a tilt-latch having means to selectively prevent latch bolt actuation.

BACKGROUND OF THE INVENTION

A pivotal sash window adapted for installation in a master frame of a sash window assembly is well-known. The sash window assembly typically has opposed, vertically extending guide rails to enable vertical reciprocal sliding movement of the sash window in the master frame while cooperatively engaged with the guide rails. The sash window has a top sash rail, a base and pair of stiles cooperatively connected together at adjacent extremities thereof to form a rectangular sash frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. A control button on the latch bolt extends through an opening on the upper surface of the housing. An operator can use his finger to engage the button and actuate the latch bolt wherein the latch bolt is retracted into the housing. This releases the latch bolt from the guide rail. When the latch bolts of the opposed tilt-latches are actuated simultaneously, the sash window can then be pivoted.

Certain tilt-latches have been surface mounted on the top sash rail, such as shown in U.S. Pat. Nos. 4,837,975 and 4,901,475, and assigned to Ashland Products, Inc., the assignee of the present invention. Other tilt-latches have been flush-mounted in the top sash rail, such as shown in U.S. Pat. No. 5,139,291, also assigned to Ashland Products, Inc.

Irrespective of the type of tilt-latch, typically, only the spring biasing force prevents the latch bolt from being retracted into the housing. Finger pressure overcomes this biasing force to actuate the latch bolt. In certain instances, however, the latch bolts on the tilt-latches can be inadvertently actuated. In some applications, it is desirable to selectively prevent actuation of the latch bolt.

U.S. Pat. No. 5,096,240, also assigned to Ashland Products, Inc., discloses a tilt-latch for a pivotal sash window assembly. The tilt-latch has a lock button to selectively prevent retraction of the latch bolt. While this patent discloses a tilt-latch having a functional means to selectively prevent retraction of the latch bolt, its structure requires a number of cooperating parts. It also requires a separate key or tool to position the lock button accordingly.

The present invention is provided to solve these and other problems.

SUMMARY OF THE INVENTION

It is an object of the present invention to provide a tilt-latch for a pivotal sash window assembly having a means for selectively preventing latch bolt actuation, or retraction of the latch bolt into the housing.

According to a first aspect of the invention, a tilt-latch having a bolt stop is disclosed for a sash window. The sash window is disposed within opposed guide rails on a master frame. The sash window is comprised of a top sash rail, a base and two stiles connected together at their extremities to form a frame. The tilt-latch is adapted for releasably securing the sash window to the master frame. The tilt-latch comprises a housing adapted to be supported by the top rail. The housing has an outward end opening. A latch bolt is disposed within the housing and has a nose adapted for engaging a respective one of the guide rails. A means is provided for biasing the latch bolt through the outward end opening. Also provided is a deflectable means on either the latch bolt or the housing for preventing retraction of the latch bolt into the housing.

According to another aspect of the invention, a lock button, or protrusion is located either on the latch bolt or the housing and a lock wall is located either on the housing or the latch bolt. The protrusion has a stop surface and is moveable between a first position defining a prevent position wherein the stop surface is adapted to abut the lock wall to prevent retraction of the latch bolt into the housing, and a second position defining a deflected position wherein the stop surface does not abut the lock wall to allow retraction of the latch bolt into the housing. The protrusion is biased to the prevent position.

According to a further aspect of the invention, the housing has a cover having an elongated opening. The elongated opening defines the lock wall and the protrusion is located on the latch bolt and is positioned in the elongated opening.

According to yet another aspect of the invention, the stop surface of the protrusion comprises a first vertical surface and a second inclined surface. The lock wall comprises a vertical wall and a chamfer wall wherein the first vertical surface is adapted to abut the vertical wall, and the second inclined surface is adapted to abut the chamfer wall.

According to another aspect of the invention, the protrusion is resilient and returns to the prevent position when the latch bolt is biased through the outward end opening.

According to a further aspect of the invention, the protrusion has an inclined top surface that frictionally engages an underside of the housing when the protrusion is depressed to a deflected position and the latch bolt is retracted into the housing.

According to another aspect of the invention, the protrusion is spaced from the lock wall when the latch bolt is biased through the outward end opening.

According to yet another aspect of the invention, the protrusion can be depressed simultaneously with retracting the latch bolt. An operator can use one hand to simultaneously move the protrusion and retract the latch bolt.

Other features and advantages of the invention will be apparent from the following specification taken in conjunction with the following drawings.

BRIEF DESCRIPTION OF THE DRAWINGS

FIG. 4 is a perspective view of the latch bolt of the tilt-latch;

FIG. 5 is a top plan view of the latch bolt;

FIG. 6 is a side elevational view of the latch bolt;

FIG. 7 is a cross-sectional view of the latch bolt taken along Line 7—7 of FIG. 5;

FIG. 8 is an enlarged cross-sectional view of a protrusion on the latch bolt;

DETAILED DESCRIPTION OF THE PREFERRED EMBODIMENTS

Figure 1:
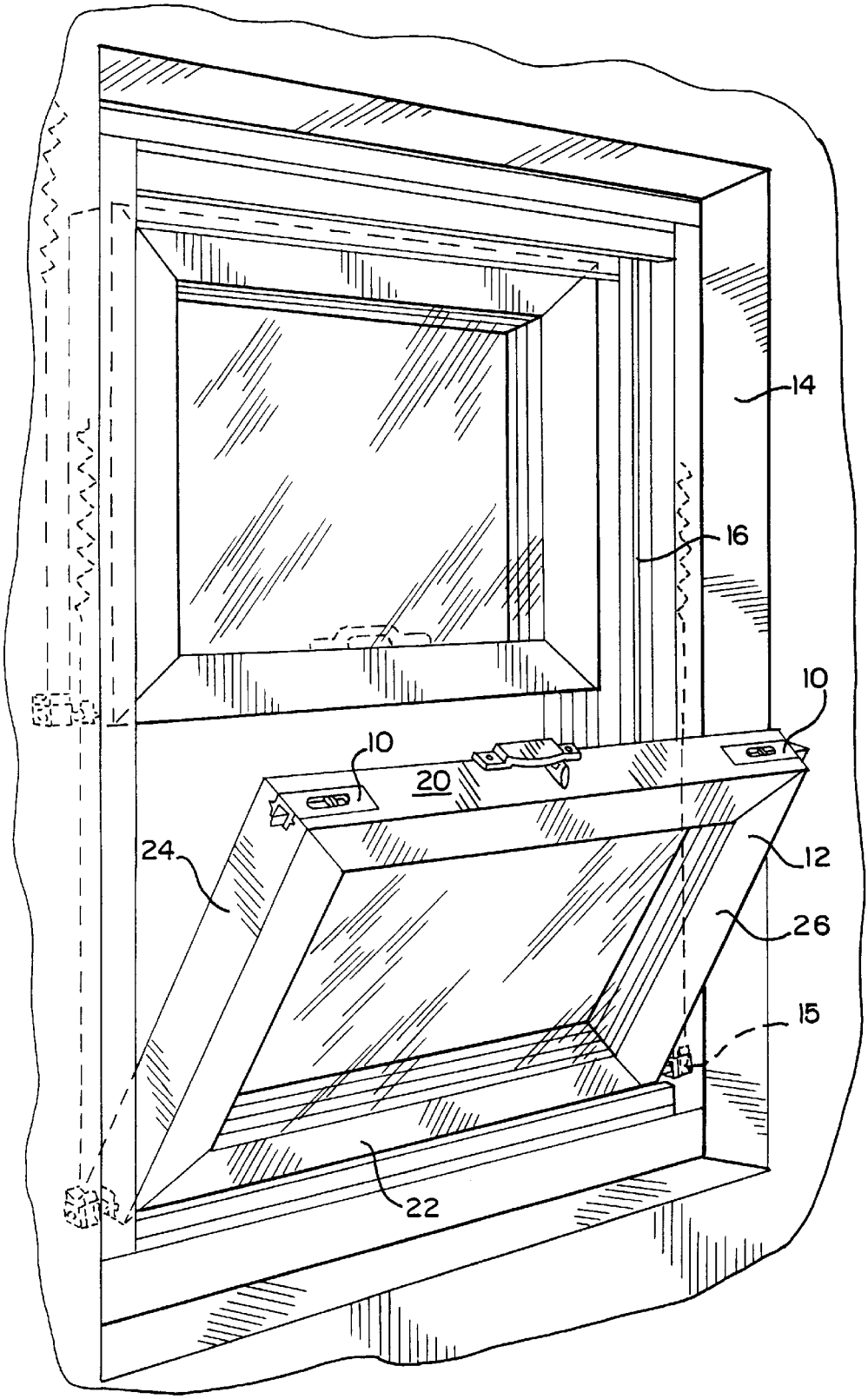
FIG. 1 is a perspective view of a double-hung sash window assembly utilizing a tilt-latch according to the invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
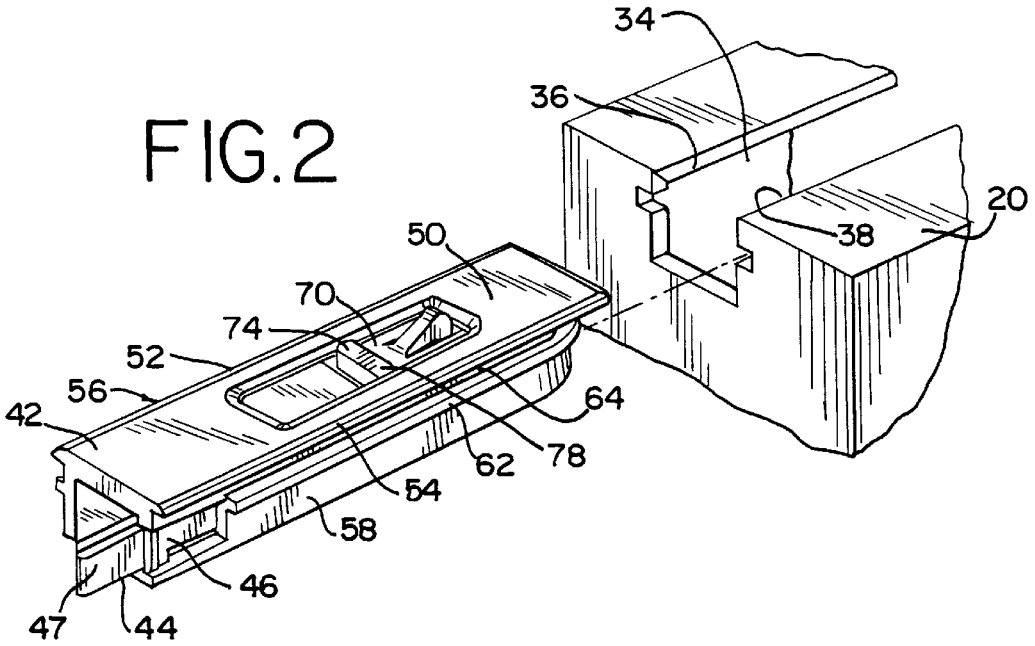
FIG. 2 is a partial exploded perspective view showing where the tilt-latch supported in a top rail of the sash window.

FIG. 1 shows a tilt-latch of the present invention, generally designated with the reference numeral 10, used in a sash window assembly 11. The sash window assembly 11 shown in FIG. 1 is a double-hung window assembly having a pivotal sash window 12 installed in a master frame 14. The sash window 12 is pivotally mounted to the master frame by a pivot-corner/balance shoe assembly 15. As is well known, the master frame 14 has opposed, vertically extending guide rails 16. The sash window 12 has a hollow top sash rail 20, a base 22 and a pair of hollow stiles 24,26, cooperatively connected together at adjacent extremities thereof to form a sash frame, typically rectangular. The sash frame could be made from extrusions or pulltrusions that are filled with fiberglass, epoxy, plastic, or wood chips. The frame could also be solid and made from wood, masonite or pressboard. As shown in FIG. 2, the top sash rail 20 includes a pair of opposing header slots 34 (one shown), which were formed as by routing the hollow top sash rail 20. Alternatively, the header slots 34 may be formed by prepunching the top sash rail 20. Each of the header slots 34 forms a pair of opposing, longitudinal header rails 36,38.

As shown in FIGS. 2, 3, and 9–11, the tilt-latch 10 generally comprises a housing 42, a latch bolt 46 and a spring 48. The housing 42 has an outward end opening 44. The housing 42 is preferably of a one-piece construction. The one-piece construction strengthens the housing 42 and simplifies assembly. The housing 42, however, could also be made from multiple pieces. The latch bolt 46 is disposed within the housing 42 and preferably has a beveled nose portion 47 to permit pivotal slamming of the sash window 12. The spring 48 biases the latch bolt 46 outwardly through the outward end opening 44, and the nose portion 47 is adapted for engaging a respective one of the guide rails 16. A base portion 49 of the housing 42 maintains the spring 48 and the latch bolt 46 in place. The base portion 49 preferably does not extend the entire length of the housing 42, thus providing an opening 49*a* (FIG. 10), which provides a stop surface for the latch bolt 46.

Figure 10:
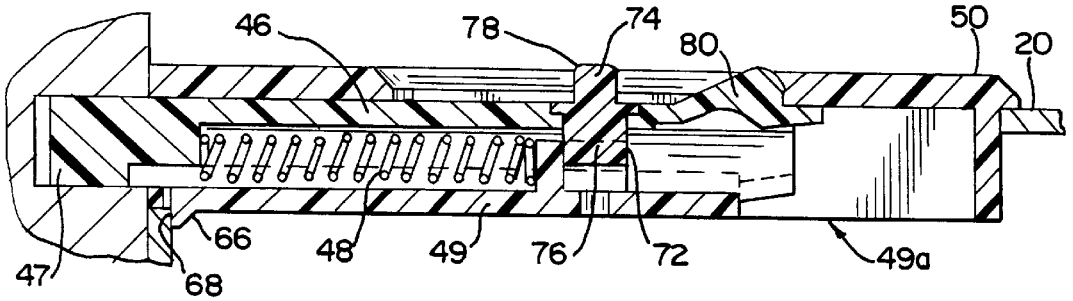
FIG. 10 is a cross-sectional view of the tilt-latch installed in a top sash rail of a sash window with the latch bolt partially retracted wherein the protrusion abuts the housing.
Figure 11:
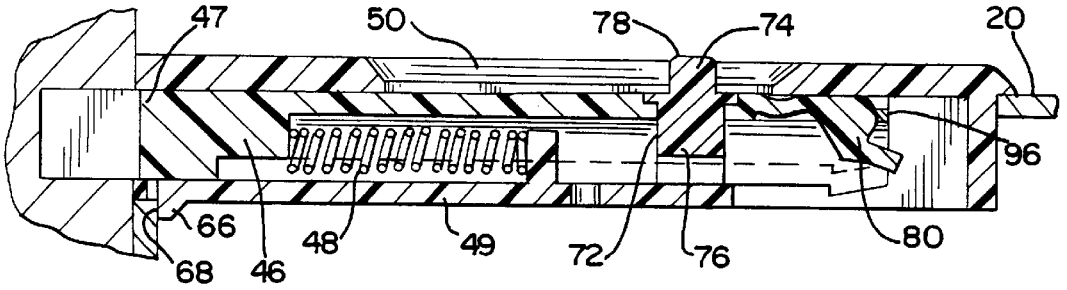
FIG. 11 is a cross-sectional view of the tilt-latch shown in FIG. 10 with the latch bolt in a retracted position.

As further shown in FIG. 2, the housing 42 has a cover 50 having opposing longitudinal edges 52,54. A pair of side walls 56,58 depend from the cover 50, and in the preferred embodiment are spaced inward of the respective longitudinal edges 52,54. Each of the side walls 56,58, has a side wall rail 62 which cooperates with a respective one of the housing cover longitudinal edges 52,54, to form a longitudinal groove 64 adapted to cooperatively receive a respective one of the header rails 36,38. The side wall rail 62 could be noncontinuous and comprised of a number of spaced projections to form a noncontinuous groove with the cover 50. The side wall rail 62 could also comprise one projection at a front portion of the sidewall and another projection on a rear portion of the sidewall. The side wall rail 62 could also extend completely around the rear of the housing 42, to provide greater contact with the header rails 36,38. The housing 42 could include a depending tab 66 for engaging the inner surface 68 of a respective one of the stiles 24,26 (FIGS. 10 and 11). The housing 42 could also have a screw hole for fastening to the top rail 20 such as if the sash frame was solid.

Figure 3:
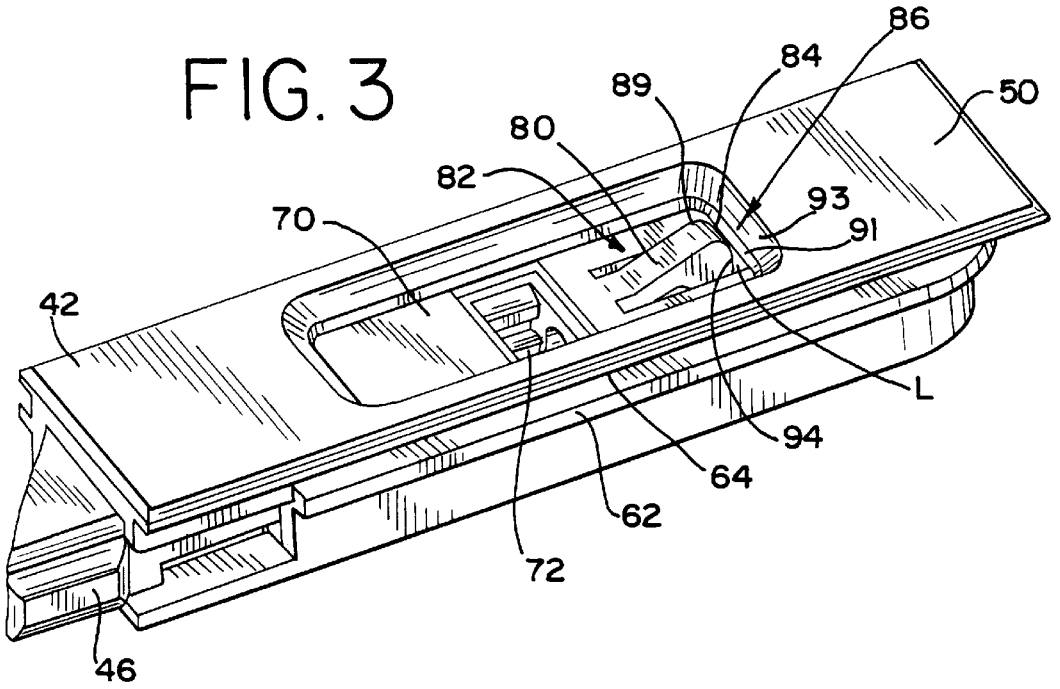
FIG. 3 is a perspective view of the tilt-latch of the present invention having a latch bolt in an extended position and with a control button removed for clarity.
Figure 12:
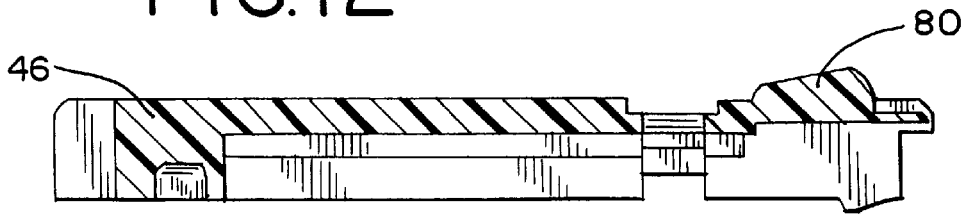
FIG. 12 is a cross-sectional view of the latch bolt having a different protrusion.
Figure 13:
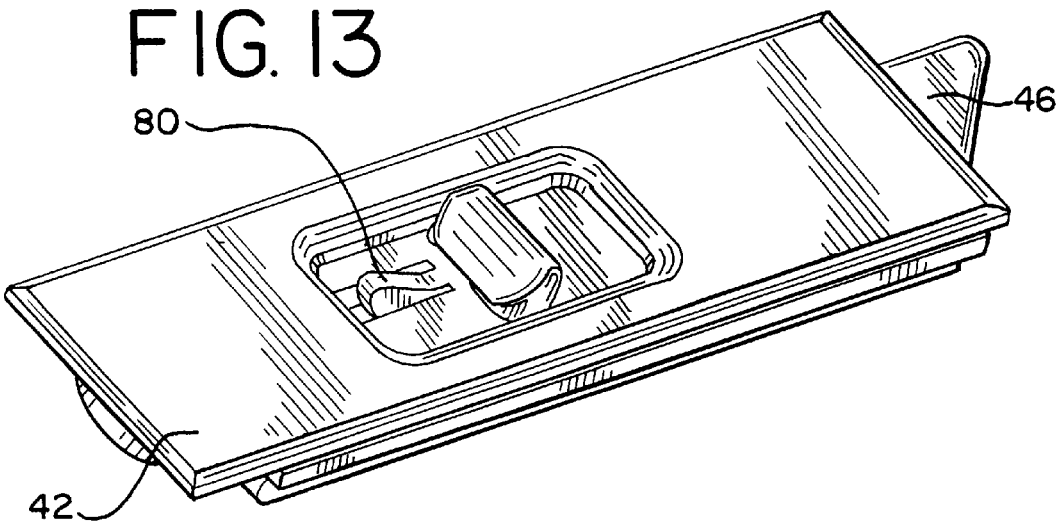
FIG. 13 is a perspective view of another tilt-latch made in accordance with the present invention.

The cover 50 of the housing 42 has an elongated opening 70. The latch bolt 46 includes a transverse slot 72 (FIGS. 3, 10). A control button 74 has a first end 76 securely received within the slot 72 and a second end 78 extending away from the slot 72 and outwardly through the elongated opening 70. FIGS. 3–7, 9 and 12 show the latch bolt 46 without the control button 74 in the slot 72. The control button 74 entirely fills the slot 72, to prevent deflection of the latch bolt 46 when depressing the control button 74. Alternatively, the slot 72 could be enlarged, and the control button 74 eliminated, to permit an operator's finger to directly retract the latch bolt 46. In such case, a second bump or friction rib could be added to be contacted by an operator's fingernail to assist in retracting the latch bolt 46. As shown in FIG. 13, the control button 74 could be integral with the latch bolt 46.

FIGS. 2–19 disclose a bolt stop included on the latch bolt 46 of the tilt-latch 10 to selectively prevent retraction of the latch bolt 46 into the housing 42. It will be noted that FIGS. 2–19 disclose a latch bolt 46 for a tilt-latch 10 for installation on the left-hand side of the top rail 20. The general structure of the tilt-latch 10 is the same for a tilt-latch 10 for installation on the right-hand side of the top rail 20. The latch bolt 46 has a lock button, or protrusion 80, extending from a top surface of the latch bolt 46. In a preferred embodiment, the protrusion 80 is integrally molded as part of the latch bolt 46 although the protrusion 80 could be separately mounted or attached. The protrusion 80 is located towards one end 82 of the latch bolt 46 such that the protrusion 80 extends into the opening 70 of the cover 50 of the housing 42. The protrusion 80 is spaced from the transverse slot 72. At one end, the protrusion 80 has a stop surface 84 that is spaced from a lock wall 86 on the housing 42. The opening 70 of the cover 50 defines the lock wall 86. The lock wall 86 includes a vertical wall 91 and, in a preferred embodiment, a chamfer wall 93. The space between the stop surface 84 and the lock wall 86 is at a distance L (FIG. 3) and provides for increased reliability as described below.

FIG. 8 shows an enlarged view of the protrusion 80. The stop surface 84 includes a first surface 85*a* that is vertical and a second surface 85*b* that is inclined. The protrusion 80 also has a top surface 88 that is downwardly inclined towards the slot 72. The protrusion 80 further has a rounded end 89. A rear finger 87 extends from the stop surface 84 of the protrusion 80. The rear finger 87 extends upwardly, preferably at an angle of 15°, and prevents the protrusion 80 from curling up out of the housing 42 as described below. The 15° angle is set for pre-installation. Once the latch bolt 46 is inserted into the housing 42, the elasticity limitations of the material are such that the protrusion 80 does not spring back to its original position. However, because of the initial incline of the protrusion 80, it springs back to an operating position wherein the second surface 85*b* of the stop surface 84 is vertical to cooperate with the vertical wall 91 of the lock wall 86, and the first surface 85*a* of the stop surface 84 is inclined to cooperate with the chamfer surface 93 of the lock wall 86. The structure and shape of the protrusion 80 provides for smooth operation as also described below. As shown in FIG. 5, a pair of slots 90,92 are formed adjacent the protrusion 80. As the latch bolt and protrusion 80 are preferably integral and preferably made from plastic, this assists the protrusion 80 in being resiliently deflectable. The protrusion 80 could be made from any material that has sufficient elasticity to permit the protrusion 80 to spring back to a prevent, or lock position. As explained in greater detail below, when the protrusion 80 is moved by depressing the protrusion 80, and deflected by retraction of the bolt 46, the protrusion 80 will spring back to an operating position.

The specific dimensions of the protrusion 80 can vary, and the inclined surface 88 can be angled at a variety of angles. The height of the protrusion 80 is such that it preferably does not extend passed the opening 70 of the cover 50, to provide a more streamlined view. The operation of the latch bolt 46 and protrusion 80 will be described below. The tilt-latch 10 is also easily preassembled by inserting the latch bolt 46 and the spring 48 in place via the outward end opening 44. The first end 76 of the control button 74 in then inserted through the elongated opening 70 and into the slot 72. A two-piece tilt-latch such as shown in FIG. 13 is assembled by inserting the latch bolt through an opening in the bottom of the housing.

Figure 14:
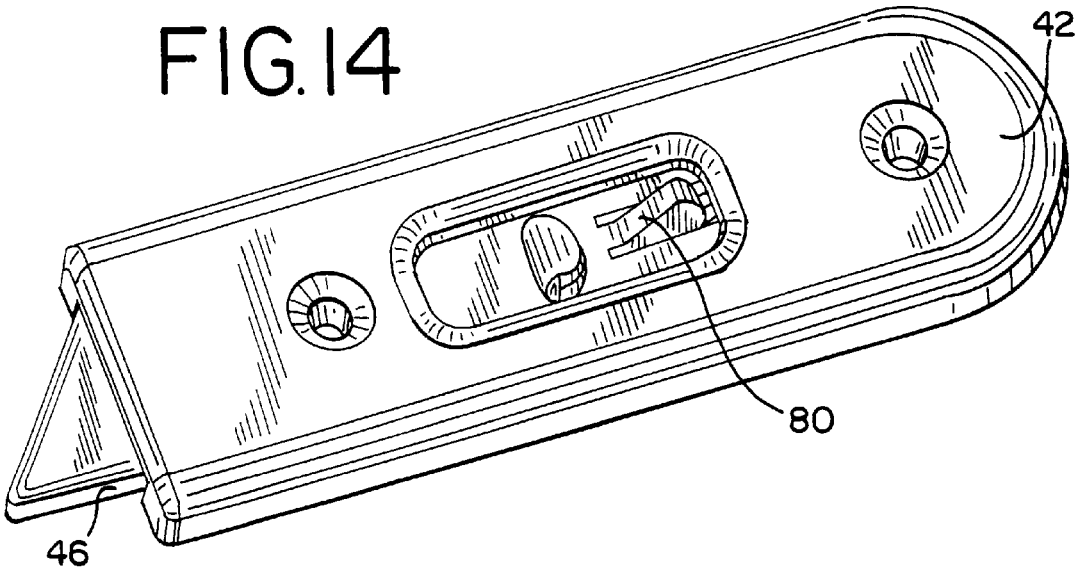
FIG. 14 is a perspective view of another tilt-latch made in accordance with the present invention.

As shown in FIG. 2, each of the tilt-latches 10 is inserted from the side into a respective one of the header slots 34, such that the pair of longitudinal grooves 64 cooperatively receive a respective pair of header rails 36,38. The tilt-latch 10 is inserted a distance until the depending tab 66 has engaged the inner surface 68 of a respective one of the stiles 24,26. It is understood that the side wall rail 62 could be beveled wherein the tilt-latch 10 could be snapped into the header slot 34 from the top of the top sash rail 20. As shown in FIG. 14, it is also understood that the present invention can be incorporated into a top-mount latch wherein the tilt-latch housing 42 is supported on an upper side of the top rail 20.

As shown in FIGS. 3 and 10, the protrusion 80 allows selective prevention of the retraction of the latch bolt 46. FIG. 3 shows the latch bolt 46 in its extended position wherein the protrusion 80 is positioned in the elongated opening 70. In this configuration, the protrusion 80 is in a prevent position 94. In the prevent position 94, the stop surface 84 of the protrusion 80 is adapted to abut the lock wall 86 to prevent retraction of the latch bolt 46 into the housing 42. Thus, when an operator attempts to retract the latch bolt 46 when the protrusion 80 is in the prevent position 94, the stop surface 84 engages the lock wall 86 to resist further movement of the latch bolt 46. FIG. 10 shows this configuration wherein the latch bolt 46 is partially retracted the distance L but still in the prevent position 94. In this position, the specific cooperating surfaces provide additional resistance. Specifically, the first surface 85*a* and the second surface 85*b* (FIG. 8) provide a pocket to cooperatively engage the chamfer wall 93 and the vertical wall 91 respectively. To depress the protrusion 80, the latch bolt 46 must be extended a distance to clear the first surface 85*a* from engaging the chamfer wall 93. It is understood that the latch bolt 46, protrusion 80 and housing 42 could be configured wherein the distance L was eliminated. In such configuration, the first surface 85*a* would be eliminated and the second surface 85*b* would be positioned at a larger angle.

Figure 9:
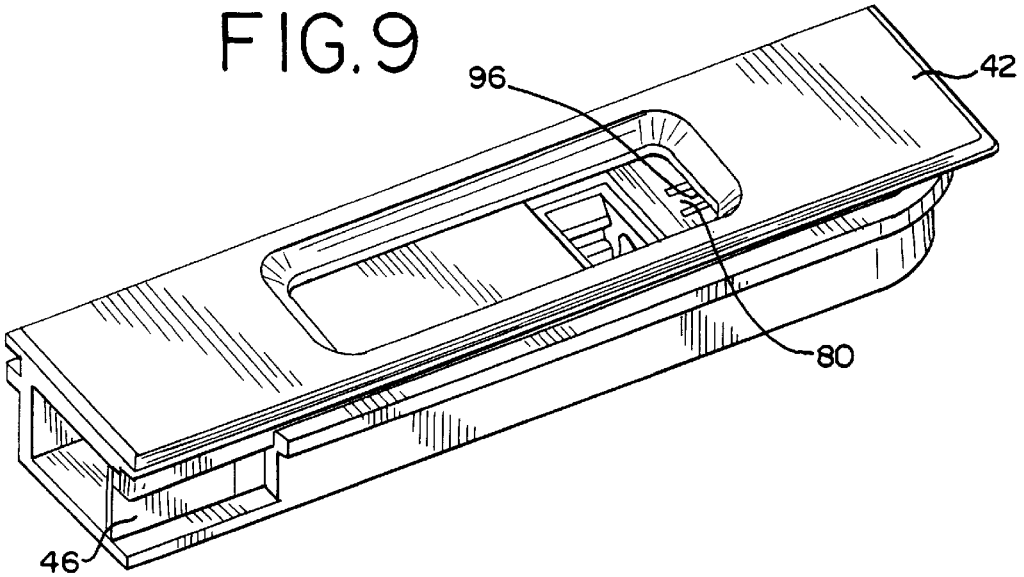
FIG. 9 is a perspective view of the tilt-latch with the latch bolt in a retracted position.

FIGS. 9–11 show how the latch bolt 46 can be retracted into the housing 42. To retract the latch bolt 46 into the housing 42, the protrusion 80 is deflectable and adapted to be depressed by an operator to define a deflected position 96 (FIG. 11). The slots 90,92 allow the protrusion 80 to reach the deflected position 96. In the deflected position 96, the protrusion 80 extends below the lock wall 86 and passes underneath the elongated opening 70 to allow retraction of the latch bolt 46 into the housing 42 by an operator applying pressure to the control button 74. As the latch bolt 46 is retracted into the housing 42, the inclined surface 88 preferably frictionally engages an underside 98 of the cover 50. Once finger pressure is removed from the control button 74, the spring 48 biases the latch bolt 46 back through the outward end opening 44. The biasing force of the spring 48 overcomes the frictional engagement between the protrusion 80 and the underside 98 of the cover 50. Because the protrusion 80 is resiliently deflectable, the protrusion 80 returns to the prevent position 94. The rear finger 87 engages the underside 98 of the housing 42 to prevent the protrusion 80 from curling up. As discussed, the initial angle of the rear finger 87 is set such that once the latch bolt 46 is inserted into the housing 42, the second surface 85*b* will be substantially vertical. As can be seen from FIGS. 3 and 9–11, the protrusion 80 is positioned to be depressed simultaneously with retracting the latch bolt. Thus, an operator can use one hand to simultaneously depress the protrusion 80 to the deflected position 96 and retract the latch bolt 46 via the control button 74.

Figure 20:
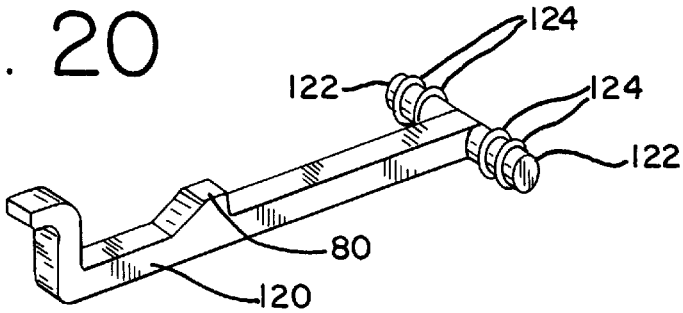
FIG. 20 is a perspective view of a control button/protrusion member.
Figure 21:
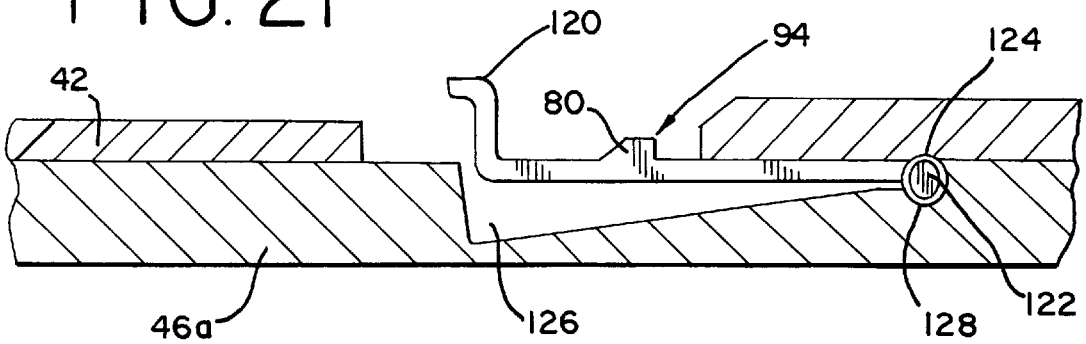
FIG. 21 is a partial cross-sectional view showing the control button/protrusion member mounted in a latch bolt in a housing.

As discussed, the protrusion 80 is resiliently deflectable and is biased to return to the prevent position 94. This is preferably achieved through the protrusion being made from plastic. Other means, however, could be used to bias the protrusion 80 to the prevent position. For example, spring forces or camming surfaces could be used to bias the protrusion. In addition, the latch bolt 46, control button 74 and protrusion 80 could be configured wherein friction and compressive forces act between the housing 42 and latch bolt 46 to bias the protrusion 80 back to the prevent position 94. For example, FIG. 20 shows a control button/protrusion member 120 having the protrusion 80. A peg 122 is included at one end. The peg 122 could be oval-shaped and has friction ribs 124. As shown in FIG. 21, the member 120 is positioned in an opening 126 provided in a latch bolt 46*a* and the peg 122 is received in a slot 128 on the bolt 46*a*, which can be circular. The member 120 can be deflected wherein the protrusion 80 does not abut the lock wall to allow retraction of the bolt 46*a* into a housing 42*a*. When the latch bolt 46*a* is biased out of the housing 42*a*, friction or compressive forces acting on the peg 122 between the housing 42*a* and the latch bolt 46*a* act to bias the protrusion 80 back to the prevent position 94.

As can be appreciated, the inclined surface 88 allows smoother retraction of the latch bolt 46 with less required force than if the surface 88 was horizontal. In addition, the rounded end 89 also allows for smoother operation and prevent the protrusion 80 from becoming caught on the underside 98 of the housing 42. The space L between the stop surface 84 of the protrusion 80 and the lock wall 86 prevents the protrusion 80 from accidentally becoming caught on the underside 98 of the cover 50. If this were to occur, the protrusion 80 could not return to the prevent position 94 and prevent retraction of the latch bolt 46. The space L, thus, assures that the protrusion 80 will snap back to the prevent position 94 when the latch bolt 46 is biased out of the outward end opening 44. Thus, it can be seen that the protrusion 80 selectively prevents retraction of the latch bolt 46 into the housing 42. In the prevent position 94, the stop surface 84 of the protrusion 80 abuts the lock wall 86 of the elongated opening 70 to prevent retraction of the latch bolt 46. In the deflected position 96, the protrusion 80 is moved away from the the lock wall 86 and the latch bolt 46 can be retracted.

While a preferred embodiment of the tilt-latch 10 having a bolt stop in the form of the protrusion 80 is shown, the tilt latch 10 having the protrusion 80 can also take other forms. Thus, other means to prevent retraction of the latch bolt 46 are possible. FIG. 12, for example, shows a latch bolt 46 having a protrusion 80 with a slightly different shape. The function of this protrusion 80 is essentially the same. The protrusion 80 can also take the form of a hinged finger mounted either on the latch bolt 46 or the housing 42. FIG. 13 shows the latch bolt 46 of the present invention utilized in another flush-mounted tilt-latch 10. This tilt-latch 10 is similar in construction to the tilt-latch 10 of FIGS. 1–11 but has a two-piece construction wherein the control button 74 is integrally molded into the latch bolt 46. As previously discussed, FIG. 14 shows the protrusion 80 in a tilt-latch 10 adapted to mounted on top of the top rail 20, i.e. a "top-mount" tilt-latch 10.

Figure 15A:
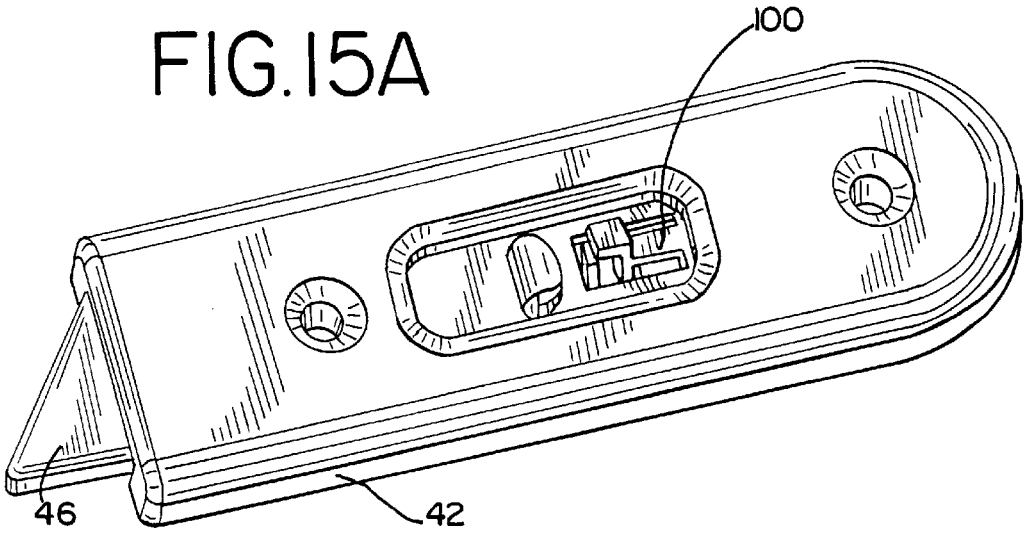
FIG. 15A is a perspective view of another tilt-latch made in accordance with the present invention.
Figure 15B:
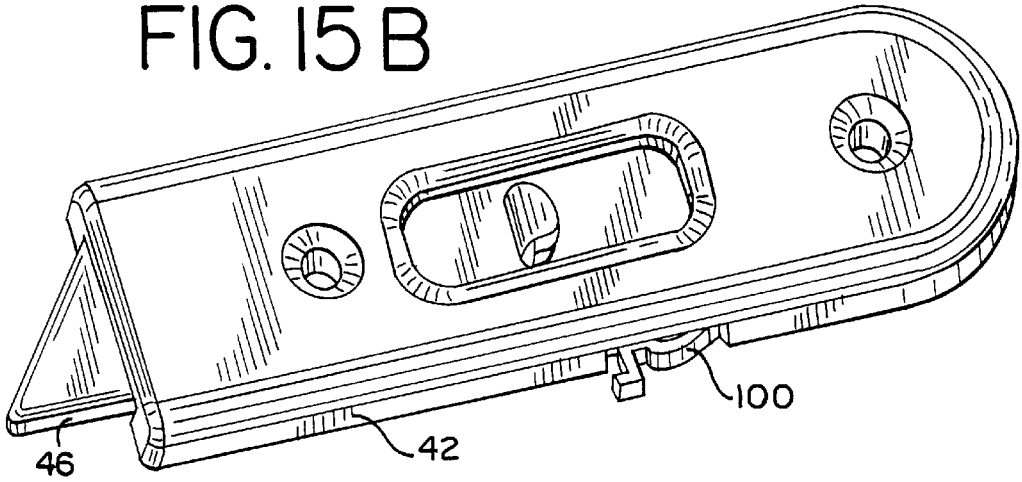
FIG. 15B is a perspective view of another tilt-latch made in accordance with the present invention.
Figure 16:
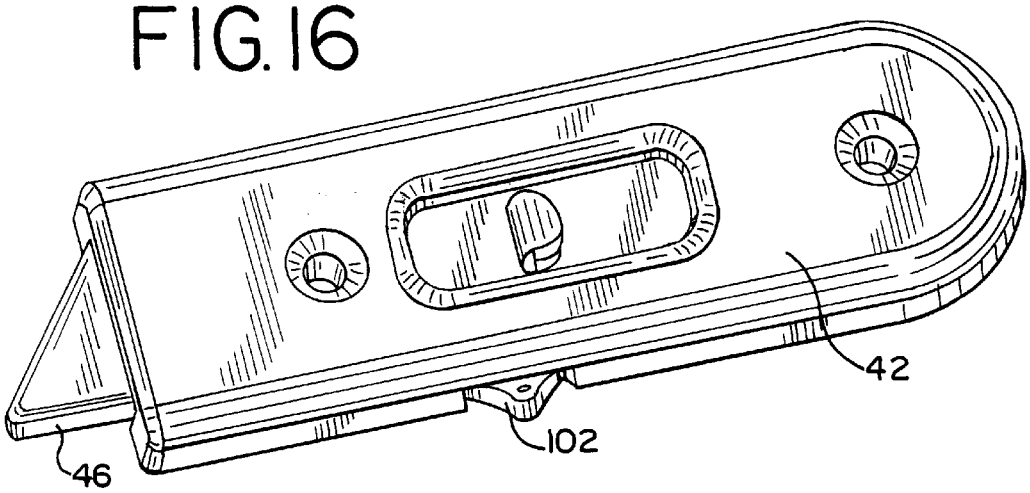
FIG. 16 is a perspective view of another tilt-latch made in accordance with the present invention.
Figure 17:
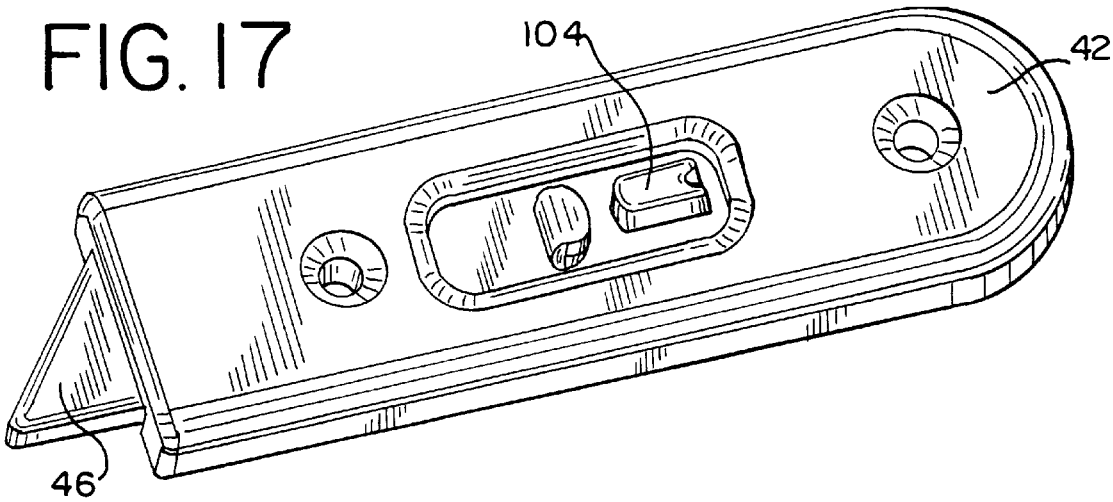
FIG. 17 is a perspective view of another tilt-latch made in accordance with the present invention.
Figure 18:
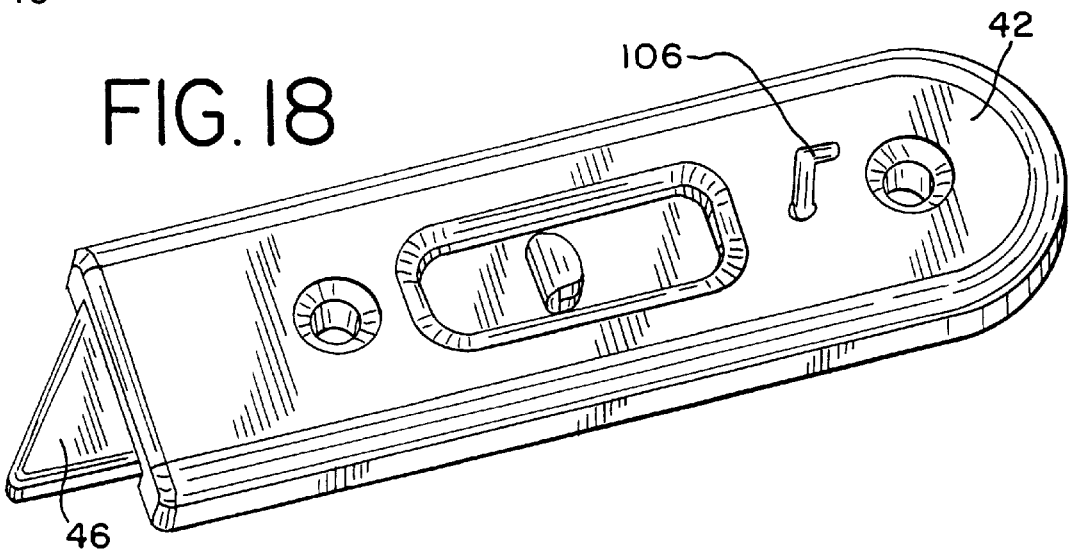
FIG. 18 is a perspective view of another tilt-latch made in accordance with the present invention.

The protrusion 80 could be mounted either on the latch bolt 46 or the housing 42 of the tilt-latch 10. For example, FIG. 15A shows a tilt-latch 10 having a deflectable protrusion 100 mounted on the housing 42. The protrusion 100 cooperates with an opening in the latch bolt 46 to prevent retraction of the latch bolt 46 into the housing. The protrusion 100 can be deflected upwards (or configured to be deflected downwards) to allow retraction of the latch bolt 46. The deflectable protrusion 100 could also be mounted on a side of the housing 42 as shown in FIG. 15B. If a flush-mounted tilt-latch 10 was used, an opening would have to be provided in the side of the top rail 20. FIG. 16 also shows a deflectable protrusion 102 mounted on the latch bolt 46 and extending through an opening in the side of the housing 42. The protrusion 102 must be depressed into the housing 42 to allow retraction of the latch bolt 46. FIG. 17 shows a tilt-latch 10 wherein a protrusion can take the form of an extendable finger 104. The finger 104 can be retracted into the latch bolt 46 to allow retraction of the latch bolt 46. FIG. 18 shows a tilt-latch 10 having a retractable pin 106 that can be biased to prevent retraction of the latch bolt 46. The pin 106 can be moved to allow retraction of the latch bolt 46. In these additional embodiments, it is understood that the housing 42 and protrusions provide the appropriate stop surfaces and lock walls.

Figure 19:
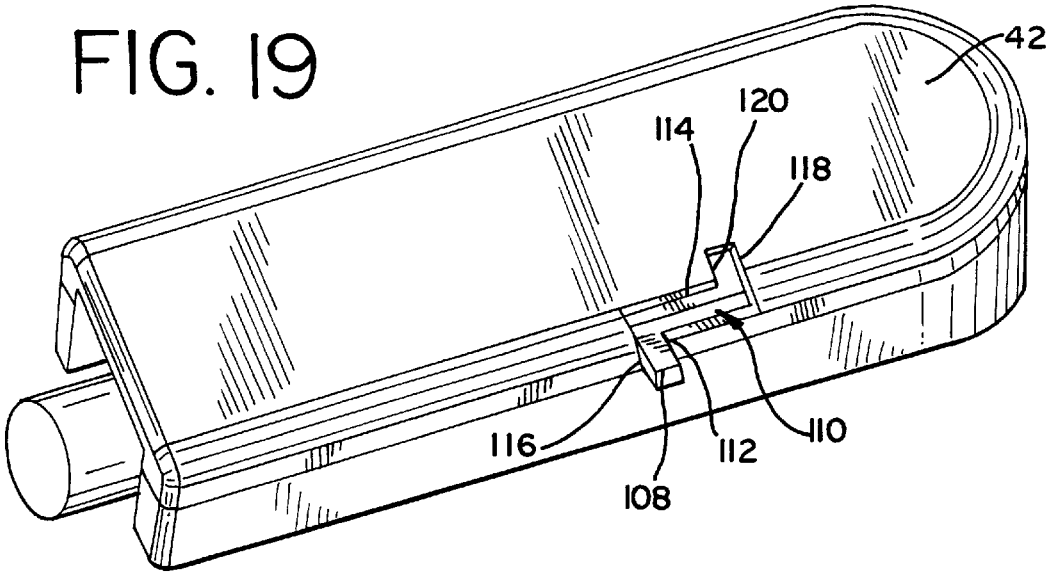
FIG. 19 is a perspective view of another tilt-latch made in accordance with the present invention.

Finally, FIG. 19 shows a tilt-latch 10 having another means to prevent retraction of the latch bolt 46 into the housing 42. The housing 42 can be supported by the top rail 20 by a number of suitable means such as screws (not shown). The latch bolt 46 has a control button 108 that is integral with or connected to the latch bolt 46. The housing 42 has a slot 110 that defines a lock wall 112. The slot 110 comprises a first section 114 in communication with a first transverse section 116 at one end and a second transverse section 118 at another end. The second transverse section 118 defines a second lock wall 120. The control button 108 abuts the lock wall 112 to prevent retraction of the latch bolt 46. The control button is then rotated, thus rotating the latch bolt 46, wherein the control button is aligned with the first section 114 to allow retraction of the latch bolt 46. If desired, the control button 108 can be further rotated into the second transverse section 118 wherein the control button 108 is adapted to engage the second lock wall 120 to maintain the latch bolt 46 in a retracted position.

The tilt-latch 10 is preferably injected-molded of strong resin, such as nylon. In heavy duty applications, 30% glass filled nylon may be used. Other materials could be substituted such as zinc.

While specific embodiments have been illustrated and described, numerous modifications come to mind without significantly departing from the spirit of the invention, and the scope of protection is only limited by the scope of the accompanying claims.

We claim:

1. For a sash window disposed within opposed guide rails on a masterframe, the sash window comprised of a top rail, a base and two stiles connected together at their extremities to form a frame, a tilt-latch adapted for releasably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

means for biasing the latch bolt through the outward end opening;

a protrusion located on one of the latch bolt and the housing and a lock wall located on the other of the housing and the latch bolt, the protrusion having a stop surface and moveable between a first position defining a prevent position wherein the stop surface abuts the lock wall as the latch bolt is attempted to be retracted to prevent retraction of the nose of the latch bolt into the housing, and a second position defining a deflected position wherein the stop surface does not abut the lock wall to allow retraction of the latch bolt into the housing; and, means for biasing the protrusion to the prevent position.

2. The tilt-latch of claim 1 wherein the housing has a cover having an elongated opening, the elongated opening defining the lock wall located on the housing and the protrusion is located on the latch bolt and positioned in the elongated opening.

3. The tilt-latch of claim 2 wherein the protrusion extends below the cover.

4. The tilt-latch of claim 2 wherein the protrusion has an inclined top surface, the inclined top surface frictionally engaging an underside of the cover of the housing when the protrusion is moved to the second position and the latch bolt is retracted into the housing.

5. The tilt-latch of claim 2 wherein the protrusion has a finger that engages an underside of the cover of the housing when the latch bolt is in the prevent position.

6. The tilt-latch of claim 6 wherein the finger is inclined.

7. The tilt-latch of claim 1 wherein the stop surface of the protrusion comprises a first vertical surface and a second inclined surface and the lock wall comprises a vertical wall and a chamfer wall, the first vertical surface adapted to abut the chamfer wall and the second inclined surface adapted to abut the vertical wall when the protrusion is in the first position.

8. The tilt-latch of claim 1 wherein the protrusion is resilient and returns to the prevent position when the latch bolt is biased through the outward end opening.

9. The tilt-latch of claim 1 wherein the protrusion has a rounded end.

10. The tilt-latch of claim 1 wherein the housing has a cover and a sidewall, the sidewall depending from the cover, the sidewall having an opening defining the lock wall located on the housing and the protrusion is mounted on the latch bolt and positioned in the opening.

11. The tilt-latch of claim 1 wherein the protrusion is integral with the bolt.

12. The tilt-latch of claim 1 wherein the protrusion is spaced from the lock wall when the latch bolt is biased through the outward end opening.

13. The tilt-latch of claim 1 wherein the protrusion can be moved simultaneously with retracting the latch bolt.

14. The tilt-latch of claim 1 wherein an operator can use one hand to simultaneously move the protrusion and retract the latch bolt.

15. The tilt-latch of claim 1 wherein the housing is adapted to be received in a header slot of the top rail.

16. For a sash window disposed within opposed guide rails on a frame, the sash window comprised of a top rail, a base and two stiles together at their extremities to form a frame, a tilt-latch adapted for releasably securing the sash window to the master frame, the tilt-latch comprising:

a housing adapted to be supported by the top rail, the housing having an outward end opening;

a latch bolt disposed within the housing and having a nose adapted for engaging a respective one of the guide rails;

means for biasing the latch bolt through the outward end opening; and, deflectable means on one of the latch bolt and the housing for preventing retraction of the nose of the latch bolt into the housing as the latch bolt is attempted to be retracted.

17. The tilt-latch of claim 16 wherein the deflectable means has a first position defining a prevent position to prevent retraction of the latch bolt into the housing and is moveable to define a deflected position to allow retraction of the latch bolt into the housing.

18. The tilt-latch of claim 16 wherein the deflectable means is positioned on the latch bolt and includes a cooperating wall on the housing to prevent retraction of the latch bolt into the housing, the deflectable means being deflectable to allow retraction of the bolt into the housing.

19. For a sash window disposed within opposed guide rails on a master frame, the sash window comprised of a top rail, a base and two stiles connected together at their extremities to form a frame, a tilt-latch adapted for releasably securing the sash window to the master frame, the tilt-latch comprising:

a housing adapted to be supported by the top rail, the housing having an outward end opening and a lock wall, the lock wall being located on the housing;

a latch bolt disposed within the housing and having a nose adapted for engaging a respective one of the guide rails;

means for biasing the latch bolt through the outward end opening;

a protrusion located on the latch bolt, the protrusion having a stop surface and being moveable between a first position defining a prevent position wherein the stop surface abuts the lock wall as the latch bolt is attempted to be retracted to prevent retraction of the nose of the latch bolt into the housing, and a second position defining a deflected position wherein the stop surface does not abut the lock wall to allow retraction of the latch bolt into the housing; and, means for biasing the protrusion to the prevent position.

20. For a sash window disposed within opposed guide rails on a master frame, the sash window comprised of a top rail, a base and two stiles connected together at their extremities to form a frame, the top rail having opposed header slots, a tilt-latch adapted for releasably securing the sash window to the master frame, the tilt-latch comprising:

a housing adapted to be supported in the header slot, the housing having an outward end opening and a lock wall, the lock wall being located on the housing;

a latch bolt disposed within the housing and having a nose adapted for engaging a respective one of the guide rails;

means for biasing the latch bolt through the outward end opening;

a protrusion located on the latch bolt, the protrusion having a stop surface and being moveable between a first position defining a prevent position wherein the stop surface abuts the lock wall as the latch bolt is attempted to be retracted to prevent retraction of the nose of the latch bolt into the housing, and a second position defining a deflected position wherein the stop surface does not abut the lock wall to allow retraction of the latch bolt into the housing, and, means for biasing the protrusion to the prevent position.

21. For a sash window disposed within opposed guide rails on a masterframe, the sash window comprised of a top rail, a base and two stiles connected together at their extremities to form a frame, a tilt-latch adapted for releasably securing the sash window to the master frame, the tilt-latch comprising:

a housing adapted to be supported by the top rail, the housing having an outward end opening and a cover, the cover having an elongated opening;

a latch bolt disposed within the housing and having a nose adapted for engaging a respective one of the guide rails, said latch bolt further having a control button extending into the elongated opening;

means for biasing the latch bolt through the outward end opening;

a protrusion located on one of the latch bolt and the housing and a lock wall located on the other of the housing and the latch bolt, the protrusion having a stop surface and moveable between a first position defining a prevent position wherein the stop surface abuts the lock wall to prevent retraction of the nose of the latch bolt into the housing, and a second position defining a deflected position wherein the stop surface does not abut the lock wall to allow retraction of the latch bolt into the housing; and, means for biasing the protrusion to the prevent position.

* * * * *